US009414631B2

(12) United States Patent
Schrimpf

(10) Patent No.: US 9,414,631 B2
(45) Date of Patent: Aug. 16, 2016

(54) UPPER BODY APPAREL WITH CONCEALED POUCHES

(71) Applicant: Keith A. Schrimpf, New Bloomfield, MO (US)

(72) Inventor: Keith A. Schrimpf, New Bloomfield, MO (US)

( * ) Notice: Subject to any disclaimer, the term of this patent is extended or adjusted under 35 U.S.C. 154(b) by 704 days.

(21) Appl. No.: 13/768,325

(22) Filed: Feb. 15, 2013

(65) Prior Publication Data

US 2013/0219581 A1 Aug. 29, 2013

Related U.S. Application Data

(60) Provisional application No. 61/604,587, filed on Feb. 29, 2012.

(51) Int. Cl.

| | |
|---|---|
| ***A41D 1/00*** | (2006.01) |
| ***A41D 3/02*** | (2006.01) |
| ***A41D 27/20*** | (2006.01) |
| *A41D 1/04* | (2006.01) |

(52) U.S. Cl.

CPC ..... *A41D 27/20* (2013.01); *A41D 27/205* (2013.01); *A41D 1/04* (2013.01)

(58) Field of Classification Search

CPC ... A41D 27/20; A41D 27/201; A41D 27/205; A41D 3/00; A41D 3/005; A41D 13/0012; A41D 1/04; A41D 2400/48; A01K 1/029; A47D 13/02; A47D 13/08

USPC ..... 2/1, 84, 85, 90, 93–96, 108, 247, 248, 2/250, 253; 224/191, 576, 587

See application file for complete search history.

(56) References Cited

U.S. PATENT DOCUMENTS

| | | | | | |
|---|---|---|---|---|---|
| 1,851,294 | A * | 3/1932 | Rucker | A41B 1/00 | 2/94 |
| 2,407,888 | A * | 9/1946 | Lesser | A41D 27/20 | 2/253 |
| 4,791,681 | A * | 12/1988 | Dean | A41D 27/20 | 2/102 |
| 4,860,388 | A * | 8/1989 | Dean | A41D 27/20 | 2/106 |
| 5,517,696 | A * | 5/1996 | Krugler | A41D 27/20 | 2/247 |
| 7,631,368 | B1 * | 12/2009 | Samson | F41C 33/02 | 2/115 |
| D608,983 | S * | 2/2010 | Myers | D2/857 | |
| 8,566,963 | B2 * | 10/2013 | Ryan | A41D 27/201 | 2/252 |
| 8,839,464 | B2 * | 9/2014 | French | A41D 27/20 | 2/248 |
| 2005/0223466 | A1 * | 10/2005 | Jennings | A45C 1/04 | 2/102 |
| 2008/0196140 | A1 * | 8/2008 | Mayerson | A41D 1/04 | 2/84 |
| 2010/0000003 | A1 * | 1/2010 | O. | A41D 27/20 | 2/69 |
| 2011/0023201 | A1 * | 2/2011 | Pearl | F41H 1/02 | 2/2.5 |
| 2015/0082506 | A1 * | 3/2015 | Yee | A41D 13/0012 | 2/69 |
| 2015/0144673 | A1 * | 5/2015 | Dahl | F41C 33/00 | 224/587 |
| 2015/0181960 | A1 * | 7/2015 | Goeglein | A41D 27/20 | 2/243.1 |
| 2015/0359280 | A1 * | 12/2015 | Chang | A41D 27/207 | 2/249 |

FOREIGN PATENT DOCUMENTS

| | | | | |
|---|---|---|---|---|
| FR | 2959645 | A1 * | 11/2011 | A41D 27/20 |

* cited by examiner

*Primary Examiner* — Alissa L Hoey
*Assistant Examiner* — Jameson Collier

(57) ABSTRACT

An upper body apparel with concealed pouches includes an upper body garment, an opening, and a concealed section. The concealed section is positioned within the upper body garment, and the opening, which is positioned with a front pouch of the upper body garment, allows a wearer of the upper body garment to access the concealed section. The concealed section includes at least one accessory pouch and a holster pocket. The at least one accessory pouch enables the wearer to store electronic device or any other related devices, and the holster pocket enables the wearer to concealed a gun or any other type of weapon. A loop and a securing strip secure the concealed section to a belt of the wearer's pants, where the securing strip and the loop eliminate unnecessary movement of the stored items and the upper body garment.

20 Claims, 9 Drawing Sheets

UPPER BODY APPAREL WITH CONCEALED POUCHES

The current application claims a priority to the U.S. Provisional Patent application Ser. No. 61/604,587 filed on Feb. 29, 2012.

FIELD OF THE INVENTION

The present invention relates generally to an apparatus for a hooded or non-hooded sweatshirt. More specifically, the present invention is an apparatus for a hooded or non-hooded sweatshirt with a concealed pouch which is accessible through a front pouch.

BACKGROUND OF THE INVENTION

Currently, a wearer of a hooded or non-hooded sweatshirt has no place to carry a concealed weapon or electronics devices such as a cell phone, etc. The wearer can place the items in the front pouch of the hooded or non-hooded sweatshirt, but the wearer is in great risk of those items falling out because they are not secured within the front pouch. In addition, the items inside the front pouch can bounce around when the wearer is performing any sort of athletic activity because the front pouch does not contain any compartments to more securely hold items. This can be especially dangerous when the object being carried is a concealed weapon.

It is therefore an object of the present invention to provide a hooded or non-hooded sweatshirt that has concealed inner pouches to place items, such as a weapon, cell phone, etc., so that the items can be firmly secured within the hooded or non-hooded sweatshirt.

DETAIL DESCRIPTIONS OF THE INVENTION

All illustrations of the drawings are for the purpose of describing selected versions of the present invention and are not intended to limit the scope of the present invention.

The present invention comprises an upper body garment 1, an opening 2, and a concealed section 3. The concealed section 3 is positioned within the upper body garment 1 so that valuable components, such as a wallet, a mobile phone, a flash light, a gun or any other related components, can be securely stored away. All of the stored components of the present invention are easily accessible through the opening 2. The positioning of the opening 2 and the concealed section 3 differ from a right-handed version of the present invention to a left-handed version of the present invention.

Figure 1:
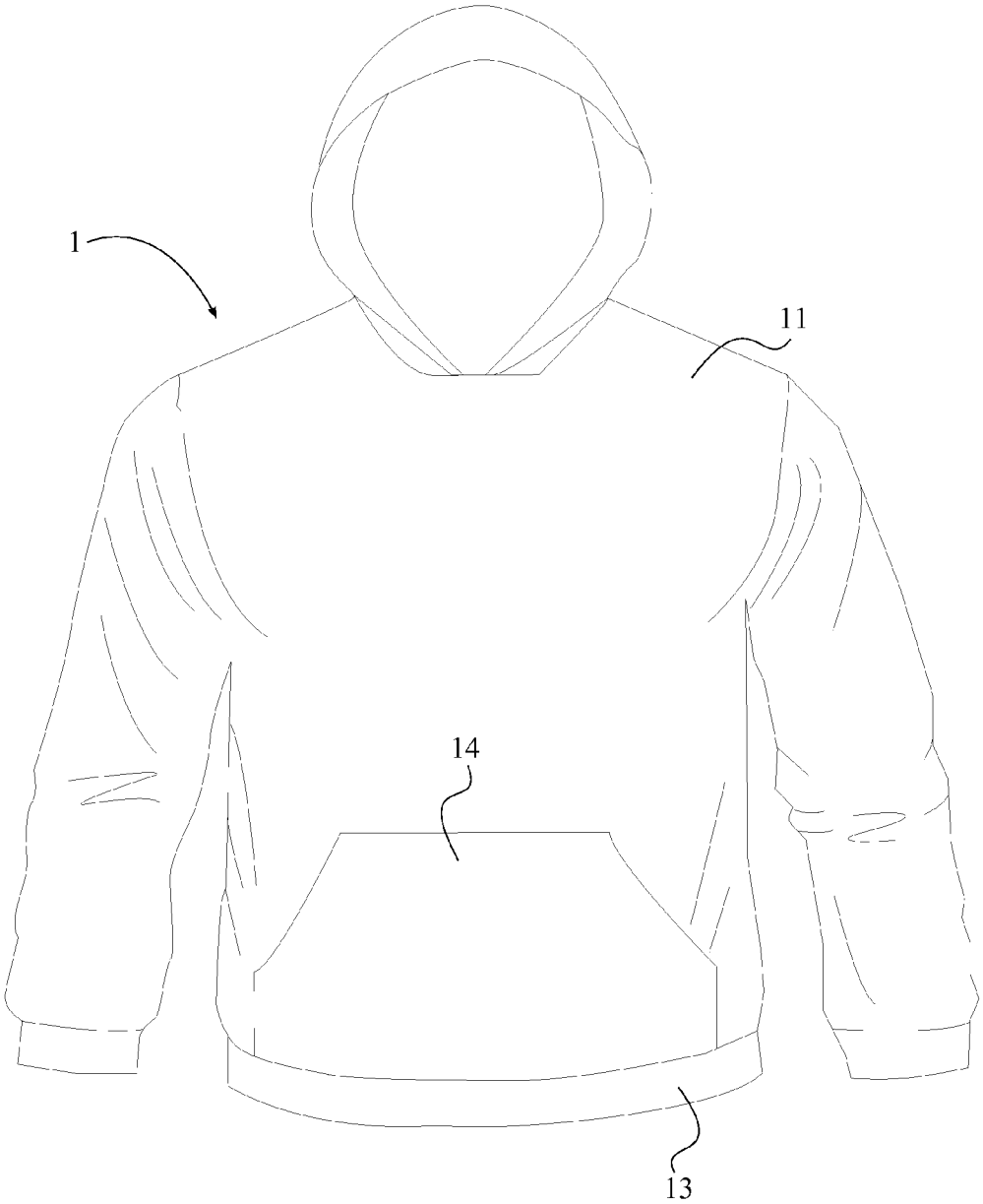
FIG. 1 is a front view of the present invention.
Figure 2:
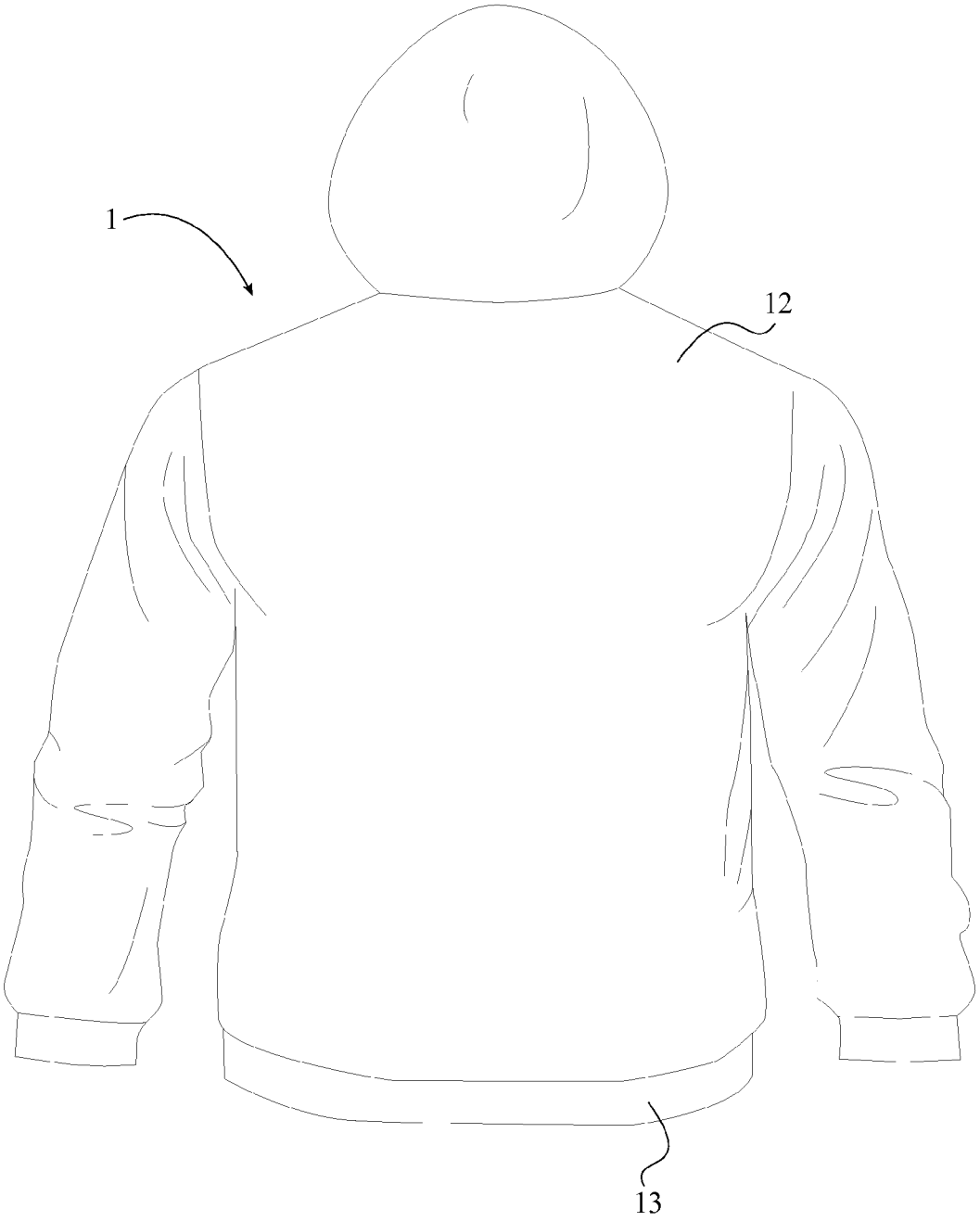
FIG. 2 is a back view of the present invention.

In reference to FIG. 1 and FIG. 2, the upper body garment 1 is very similar to traditional sweatshirts, where the upper body garment 1 comprises a front portion 11, a back portion 12, a waist band 13, and a front pouch 14. The front portion 11 and the back portion 12 are adjacently positioned from each other, and the waist band 13 is positioned below the front portion 11 and the back portion 12. The waist band 13 is perimetrically connected to the front portion 11 and the back portion 12, and the waist band 13 is preferably made from elastic materials or ribbing so that the waist band 13 can closely position around the waist of the wearer. The front pouch 14 is centrally positioned on the front portion 11 adjacent to the waist band 13, and the front pouch 14 is connected to the front portion 11 from a top edge and a bottom edge. The wearer of the present invention can access the front pouch 14 from either a left side breach or a right side breach of the front pouch 14, where the left side breach and the right side breach oppositely positioned from each other along the top edge and the bottom edge. The front portion 11 and the back portion 12 may comprise a pair of sleeve sections and a hooded section or a collared section. When the upper body garment 1 is worn by the users, the front portion 11 and the back portion 12 are positioned around the upper body of the wearers, the pair of sleeve sections is positioned around the arms of the wearers, and the hooded section or the collared section is positioned around the neck area of the wearers. A right sleeve and a left sleeve of the pair of sleeve sections are connected with an arm ribbing band, where the arm ribbing band contains the pair of sleeve sections around the arms of the users while retaining the required length for the pair of sleeve sections.

Figure 3:
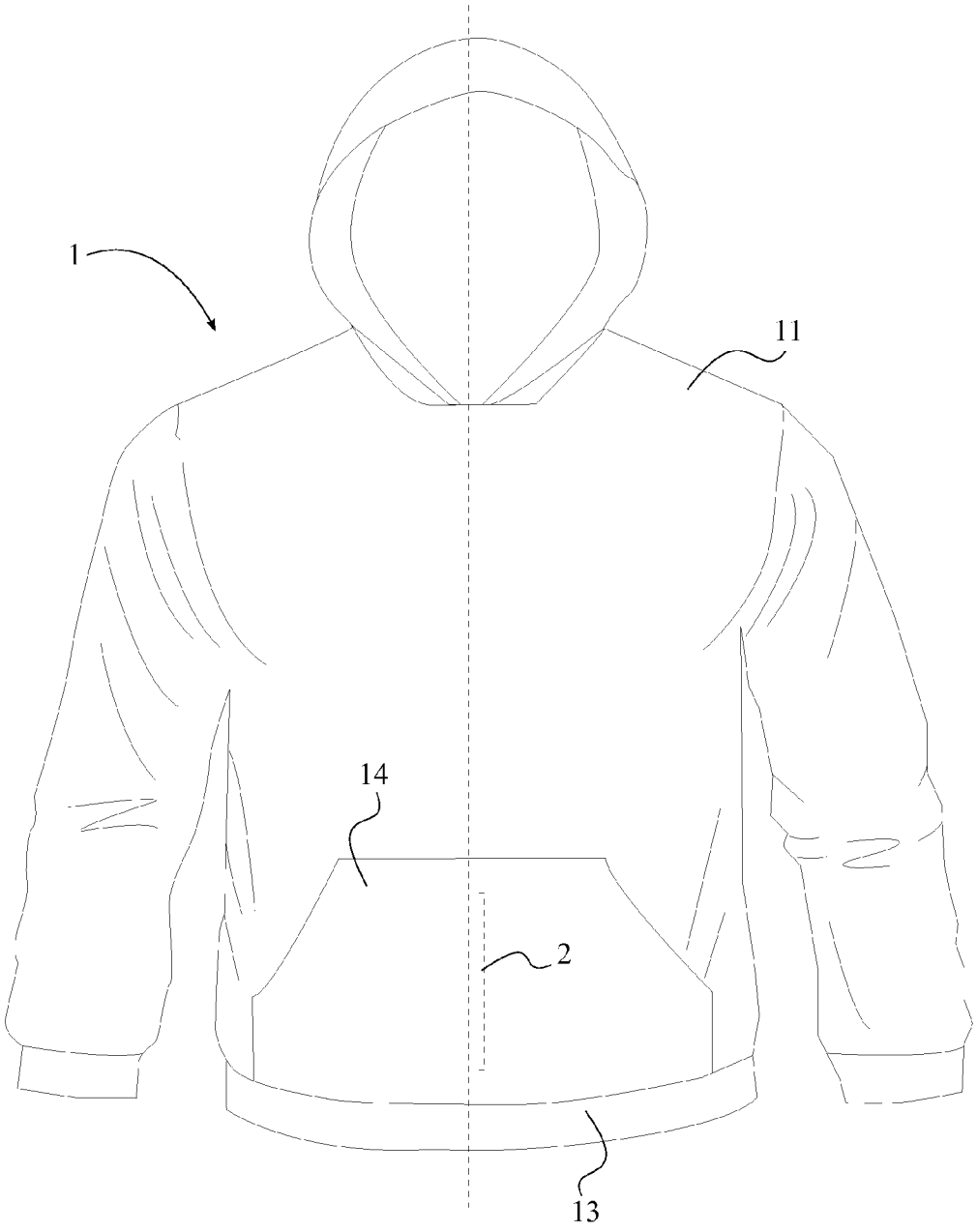
FIG. 3 is a front view of a right-handed version of present invention, wherein the smaller vertical dash line illustrates an opening and the longer vertical dash line illustrates a center line.
Figure 4:
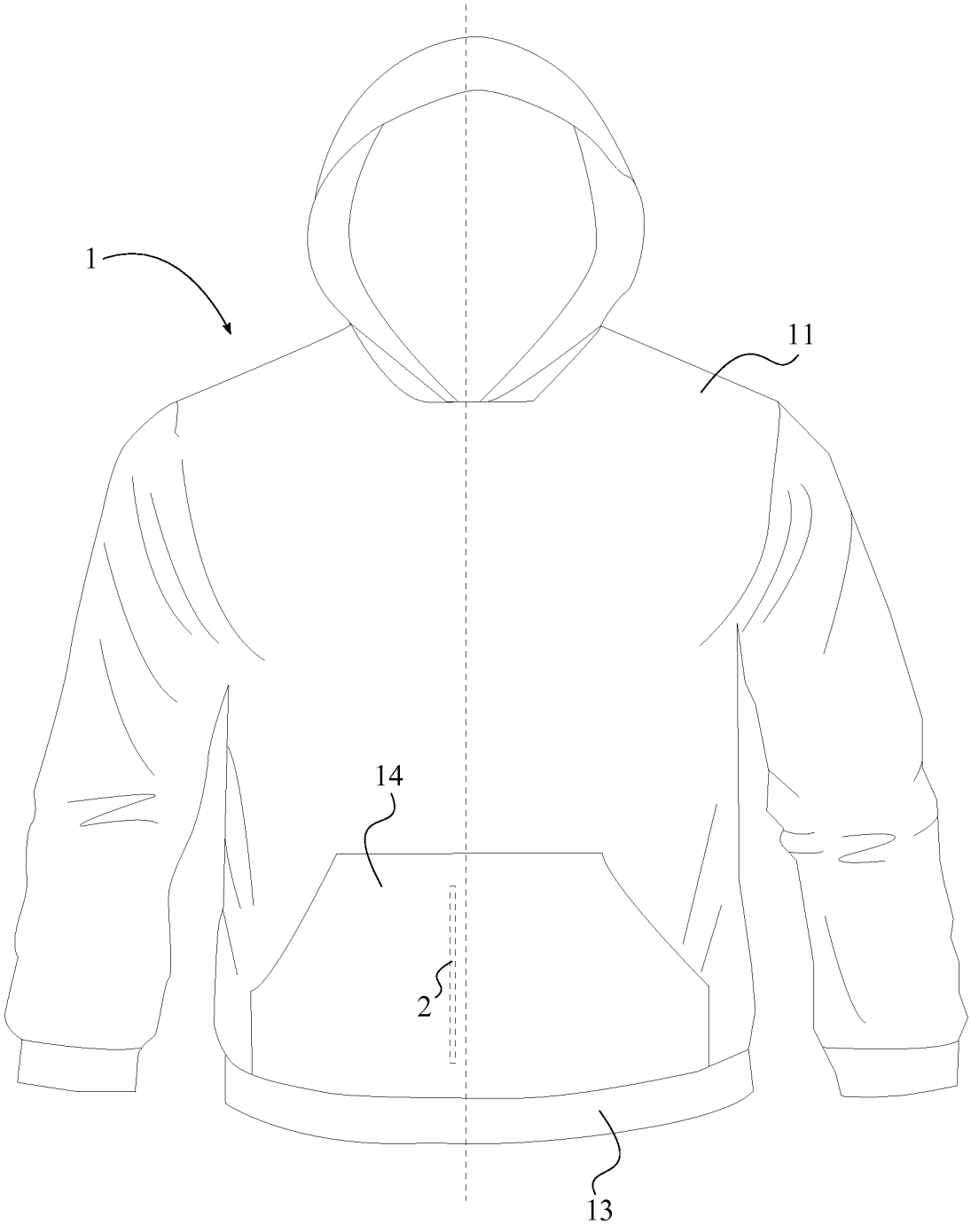
FIG. 4 is a front view of a left-handed version of present invention, wherein the smaller vertical dash line illustrates the opening and the longer vertical dash line illustrates the center line.

In reference to FIG. 3 and FIG. 4, the opening 2 is perpendicularly positioned with the waist band 13, where the opening 2 is positioned on the front panel 31 and within the front pouch 14. Since the opening 2 is positioned within the front pouch 14, the opening 2 is not visible to the outside and can only access within the front pouch 14 through the left side breach or the right side breach. In reference to FIG. 3, the opening 2 of the right-handed version of the present invention is slightly closer toward the left side breach. In reference to FIG. 4, the opening 2 of the left-handed version of the present invention is slightly closer toward the right side breach.

Figure 5:
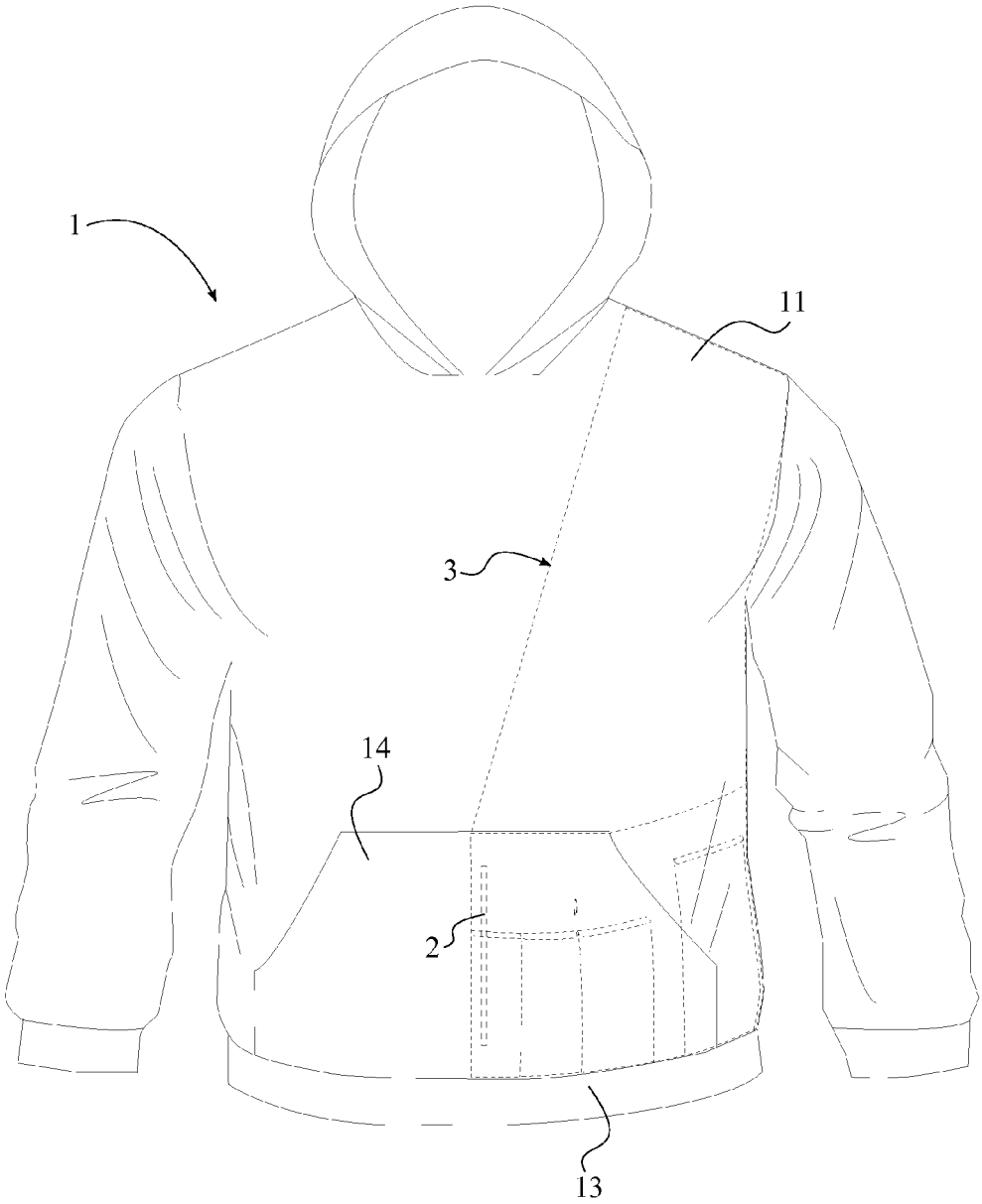
FIG. 5 is a front view of the right-handed version of the present invention, wherein the dash lines illustrate the opening and a concealed section.
Figure 6:
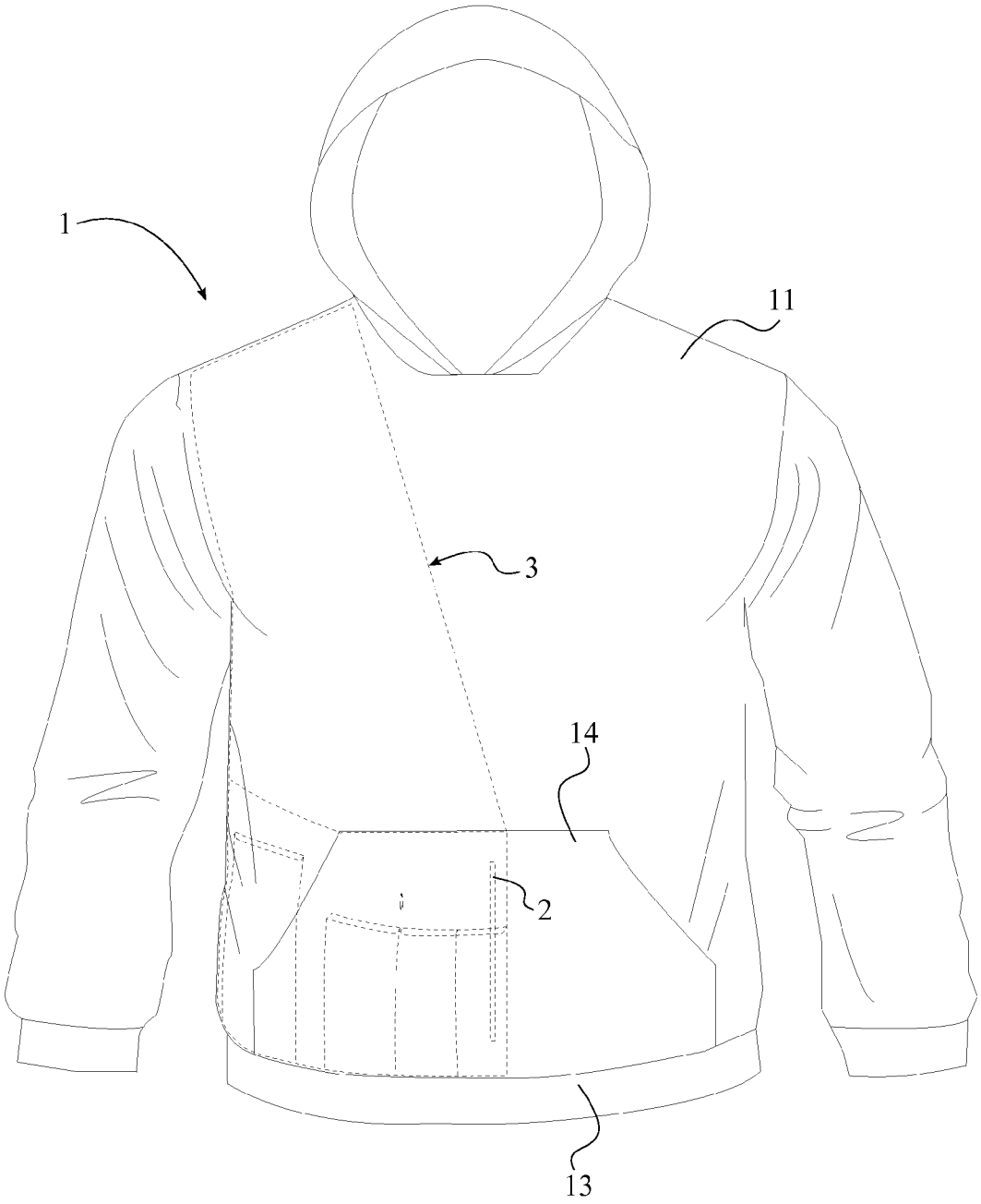
FIG. 6 is a front view of the left-handed version of the present invention, wherein the dash lines illustrate the opening and the concealed section.

In reference to FIG. 5 and FIG. 6, the concealed section 3 comprises a quilted front panel 31, a quilted back panel 32, a fastener connection flap 33, a first releasable fastener 34, at least one accessory pouch 35, a second releasable fastener 36, a holster pocket 37, a headphone wire hole 38, a loop 39, a securing strip 40, and a plurality of connecting edges 41. The quilted front panel 31 and the quilted back panel 32 complete the main body of the concealed section 3, where the quilted front panel 31 is adjacently positioned with the quilted back panel 32. The quilted back panel 32 preferably comprises a rectangular shape, and the quilted front panel 31 preferably comprises general trapezium shape, although any other desired shapes can be used. The quilted front panel 31 is positioned in between the quilted back panel 32 and the front portion 11, where the quilted back panel 32 is perimetrically connected with the quilted front panel 31.

Figure 9:
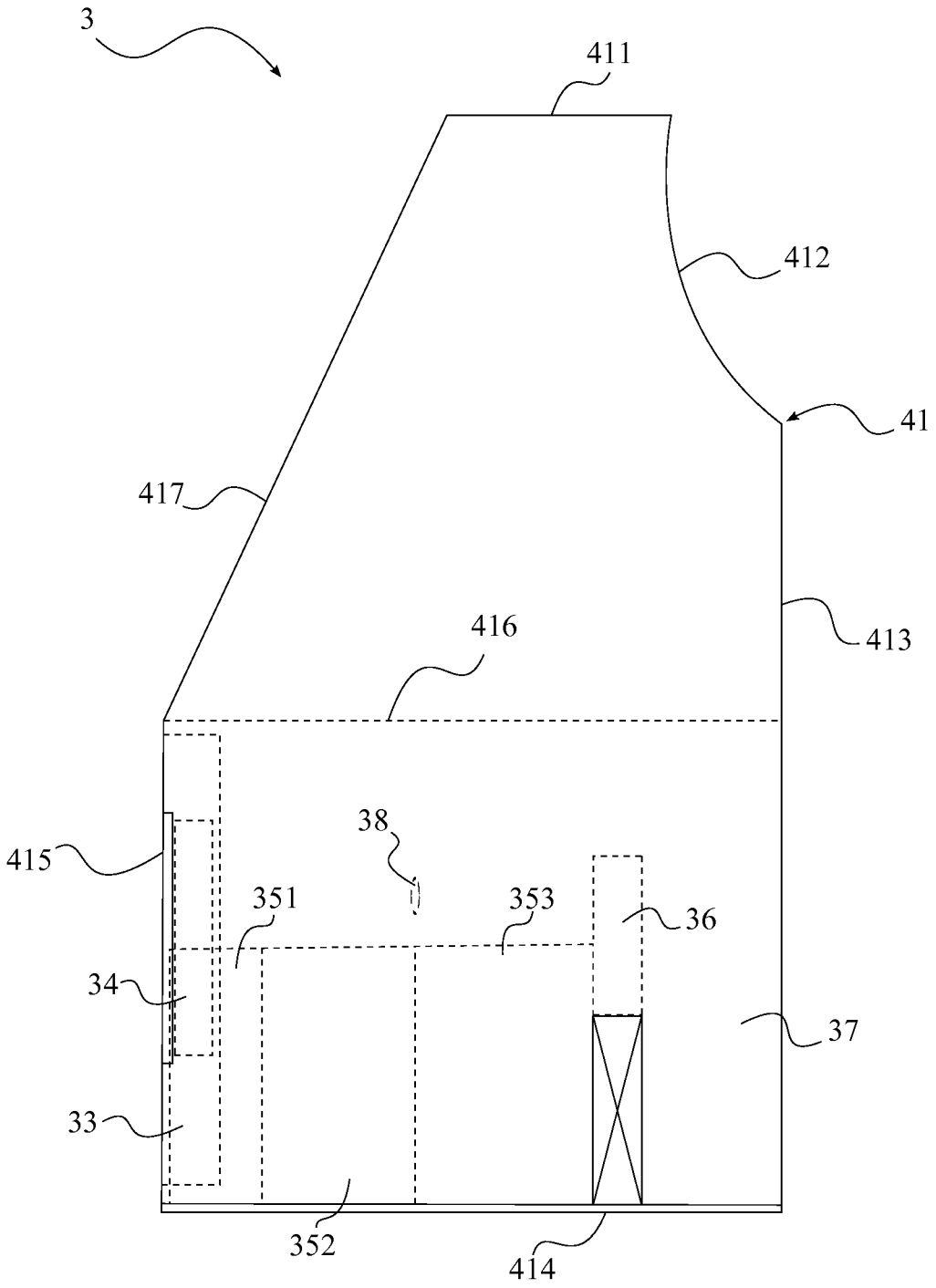
FIG. 9 is a front view of the concealed panel, wherein the dash lines illustrate components positioned behind the quilted front panel.

In reference to FIG. 9, the concealed section 3 is connected to the front portion 11 and the front pouch 14 through the plurality of connecting edges 41 where the plurality of connecting edges 41 comprises a shoulder edge 411, an arm edge 412, a rib edge 413, a waist edge 414, a linear edge 415, a pouch edge 416, and an angular edge 417. Since the plurality of connecting edges 41 is perimetrically positioned around the concealed section 3, the plurality of connecting edges 41 determines the shape of the concealed section 3. The linear edge 415 is positioned parallel with the opening 2. The rib edge 413 is oppositely positioned from the linear edge 415, where both the rib edge 413 and the linear edge 415 are perpendicularly positioned from the waist edge 414. The waist edge 414 extends from the linear edge 415 to the rib edge 413. The pouch edge 416, which extends from the linear edge 415, is positioned in between the linear edge 415 and the rib edge 413 and positioned opposite from the waist edge 414. The angular edge 417 is angularly extends toward the rib edge 413 from the linear edge 415. The shoulder edge 411 is oppositely positioned with the waist edge 414 and extends from the angular edge 417, where the shoulder edge 411 is positioned parallel with the waist edge 414. The arm edge 412 is a concave edge that is positioned in between the shoulder edge 411 and the rib edge 413. The shoulder edge 411, the arm edge 412, the rib edge 413, the waist edge 414, and the linear edge 415 are perimetrically connected to the front portion 11 while the pouch edge 416 connects with the front pouch 14 along the top edge. The angular edge 417 is freely positioned within the upper body garment 1, where the angular edge 417 does not connect with either the front portion 11 or the back portion 12. In reference to FIG. 5 and FIG. 6, the concealed section 3 of the right-handed version of the present invention is adjacently positioned behind the left side breach, and the concealed section 3 of the left-handed version of the present invention is adjacently positioned behind the right side breach. The concealed section 3 of the present invention is 100% cotton and lined with waffle fabric, although any desirable materials can be used. Dimensions of the waist edge 414 and the linear edge 415 of a preferred embodiment of the present invention are respectively 12.5" and 8.5", although any desired dimensions can be used.

Figure 7:
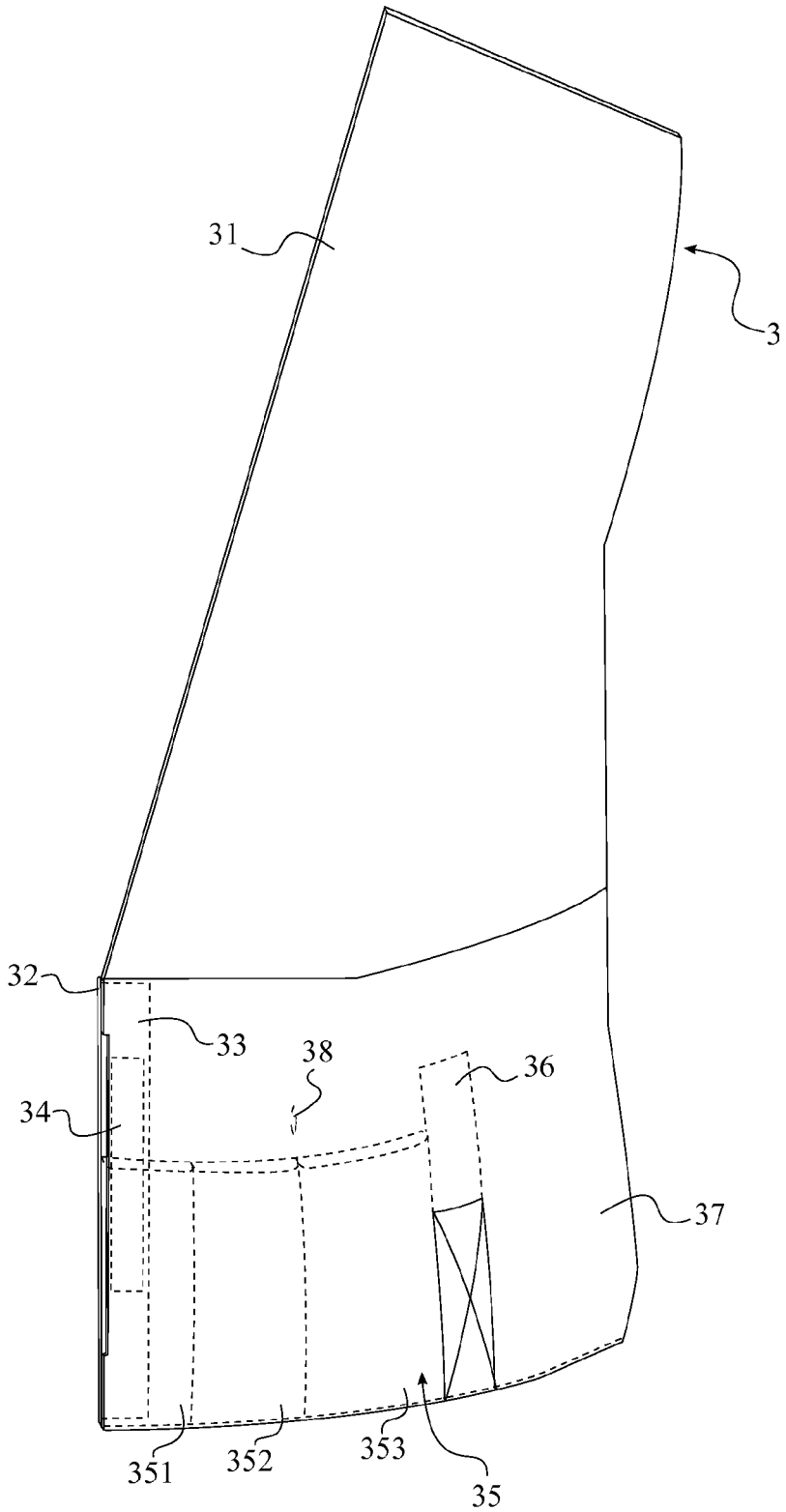
FIG. 7 is a front perspective view of the concealed section, wherein the dash lines illustrate hidden components within a quilted front panel and a quilted back panel of the concealed section.

In reference to FIG. 7, the fastener connection flap 33 is positioned in between the opening 2 and the quilted back panel 32. The fastener connection flap 33 is perimetrically connected to the waist edge 414, the linear edge 415, and the pouch edge 416.

Figure 8:
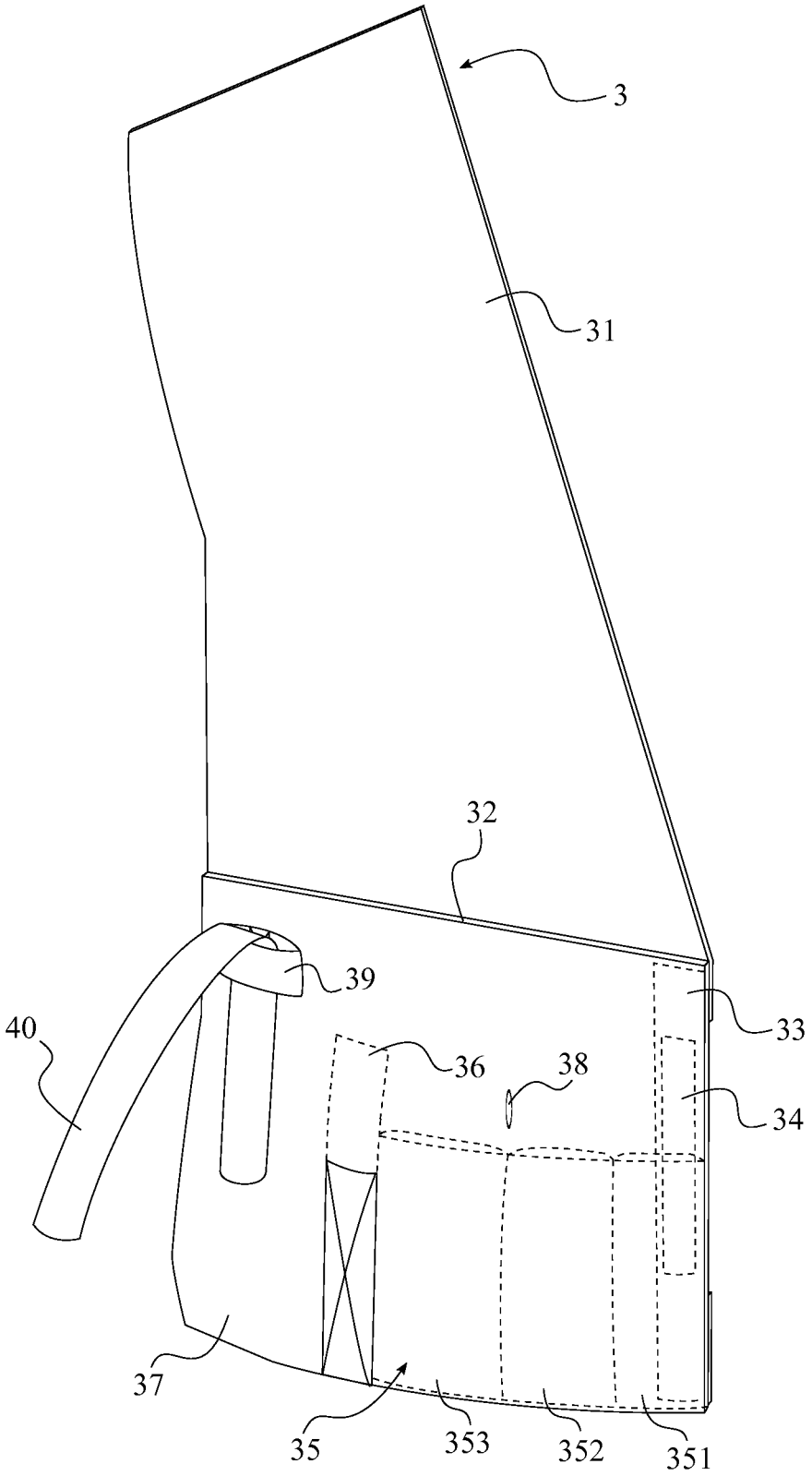
FIG. 8 is a back perspective view of the concealed section, wherein the dash lines illustrate hidden components within the quilted front panel and the quilted back panel of the concealed section.

In reference to FIG. 7 and FIG. 8, the first releasable fastener 34 is positioned in between the fastener connection flap 33 and the quilted front panel 31, where the first releasable fastener 34 centrally aligns with the opening 2. The first releasable fastener 34 is connected to the quilted front panel 31 and the fastener connection flap 33. A gap is located in between the quilted front panel 31 and the fastener connection flap 33 at each extremity of the first releasable fastener 34. The gap allows the wearers to easily open the first releasable fastener 34 as the wearers can separate the two surfaces from their fingers. In the preferred embodiment, the dimensions of the gap are preferably 1"×3.25", although any desired dimensions can be used. The second releasable fastener 36 is positioned parallel with the first releasable fastener 34 where the second releasable fastener 36 is positioned in between the quilted front panel 31 and the quilted back panel 32. A holster gap, which extends from the pouch edge 416 to the second releasable fastener 36, is located in between the quilted front panel 31 and the quilted back panel 32. The holster gap allows access to the wearers so that the wearers can easily open the second releasable fastener 36. In the preferred embodiment, the dimensions of the holster gap are preferably 1"×3.25", although any desired dimensions can be used. Only a top half of the second releasable fastener 36 opens through the holster gap, as a bottom half of the second releasable fastener 36 is permanently connected to the quilted front panel 31 and the quilted back panel 32 combining the quilted front panel 31 and the quilted back panel 32 together. The first releasable fastener 34 and the second releasable fastener 36 include, but not limited to, hook and loop fasteners, zippers, magnetic fasteners, or any other easily operated fasteners.

In reference to FIG. 7, the at least one accessory pouch 35 is positioned on the quilted back panel 32 in between the first releasable fastener 34 and the second releasable fastener 36. The at least one accessory pouch 35 comprises a first pouch 351, a second pouch 352, and a third pouch 353. The first pouch 351 is adjacently positioned with the first releasable fastener 34 and connected to the quilted back panel 32. The third pouch 353 is adjacently positioned with the second releasable fastener 36 and connected to the quilted back panel 32. The second pouch 352 is positioned in between the first pouch 351 and the third pouch 353 and connected to the quilted back panel 32. The first pouch 351, the second pouch 352, and the third pouch 353 are linearly positioned next to each other along the waist edge 414. In the preferred embodiment, the first pouch 351 has a width of 1.5", and the second pouch 352 and the third pouch 353 have a width of 3.5", although any desired dimensions can be used. The preferable length of the first pouch 351, the second pouch 352, and the third pouch 353 of the preferred embodiment is 5", although any desired dimensions can be used. The headphone wire hole 38 is traversed through the quilted back panel 32, where the headphone wire hole 38 is adjacently positioned above the second pouch 352 and the third pouch 353. The distance between the headphone wire hole 38 and the second pouch 352 of the preferred embodiment is ½", although any desirable distance may be used. The first pouch 351, the second pouch 352, and the third pouch 353 can be used to store items such as the wallet, the mobile phone, portable music and video players, the flash light, and other essential components. When a headphone set of the mobile phone or the portable music player is inserted within the ears of the wearers, the headphone set can be redirected though a neck opening of the hooded section or the collared section and the headphone wire hole 38 so that dangling wires of the headphone set can be hidden with the present invention. The first pouch 351, the second pouch 352, and the third pouch 353 are made from elastic materials in order to accomplish secure storage for the stored items, as the elastic properties of the elastic materials restrict the movement of the stored items.

In reference to FIG. 9, the holster pocket 37 is adjacently positioned with the second releasable fastener 36 and oppositely positioned from the at least one accessory pouch 35. The holster pocket is created within the quilted front panel 31 and the quilted back panel 32 as the holster pocket 37 extends from the second releasable fastener 36 to the waist edge 414 and to the rib edge 413. The bottom half of the second releasable fastener 36 separates the holster pocket 37 from the at least accessory pouch 35. The holster pocket 37 allows the wearers of the present invention to conceal a gun or any other type of weapon within the present invention. Since the access to the holster pocket 37 is closed through the second releasable fastener 36, the wearers of the present invention have to open the second releasable fastener 36 to access the holster pocket 37.

In reference to FIG. 8, the loop 39 is positioned on the quilted back panel 32 opposite from the holster pocket 37. The loop 39 is connected to the quilted back panel 32 and the rib edge 413, where the loop 39 is positioned parallel with the waist edge 414. The securing strip 40, which comprises hooks and loops attachment mechanism or any other type of attachment mechanisms, is movably inserted through the loop 39. The securing strip 40 is positioned within the loop 39 so that the securing strip 40 can be attached around a belt of wearer's pants, where the securing strip 40 reduces the vertical movement, the horizontal movement, and the angular movement of the stored items.

The present invention also comprises a main tag, a first informational tag, and a second information tag. The main tag can be stitched, printed or silk screened to the back portion 12 adjacent with the hooded section or the collared section. In the preferred embodiment, the main tag is preferably positioned ¼ " from the hooded section or the collared section. For each different sizes of the present invention, such as small, medium, large, and etc., the size of the main tag is slightly different. The main tag may include information such as the exact size of the present invention, the brand name, and other user related information. A front side and a reverse side of the first informational tag comprises material information, material caring information, a color code, a reference code, and other related information so that the consumers can be well educated about the present invention. The first information tag can be connected to an inside surface of the waist band 13 or within the front portion 11 or the back portion 12. The second information tag, which is doubled sided and comprises information regarding the layout and the functionally of the concealed section 3, is anchored on the arm ribbing band of the left sleeve or the right sleeve by an anchor. In the preferred embodiment, the second information tag hangs 1" from the left sleeve or the right sleeve, where the second information tag is preferably 2" and the anchor is preferably 3".

Even though the present invention comprises only one concealed section 3 within the upper body garment 1, an alternative embodiment of the present invention may comprise two concealed sections 3 within the upper body garment 1 so that the alternative embodiment provides extra storage and comfort suit for ambidextrous wearers. When the alternative embodiment comprises two concealed sections 3, the opening 2 is centrally positioned within the front pouch 14 and, the opening 2 may comprise a left opening and a right opening for each of the concealed sections 3.

Although the invention has been explained in relation to its preferred embodiment, it is to be understood that many other possible modifications and variations can be made without departing from the spirit and scope of the invention as hereinafter claimed.

What is claimed is:

1. An upper body apparel with concealed pouches comprise:

an upper body garment;

an opening;

a concealed section;

the upper body garment comprises a front portion, a back portion, a waist band, and a front pouch;

the concealed section comprises a front panel, a back panel, a fastener connection flap, a first releasable fastener, at least one accessory pouch, a second releasable fastener, a holster pocket, a headphone wire hole, a loop, a securing strip, and a plurality of connecting edges;

the front portion and the back portion being positioned atop the waist band;

the front portion and the back portion being adjacently positioned with each other;

the waist band being perimetrically connected to the front portion and the back portion;

the front pouch being centrally positioned on the front portion and adjacently positioned with the waist band; and the concealed section being positioned within the front portion and the back portion.

2. The upper body apparel with concealed pouches as claimed in claim 1 comprise:

the opening being perpendicularly positioned with the waist band; and the opening being positioned on the front panel and within the front pouch.

3. The upper body apparel with concealed pouches as claimed in claim 1 comprise:

the concealed section being adjacently connected to the front portion and the front pouch through the plurality of connecting edges;

the plurality of connecting edges comprises a shoulder edge, an arm edge, a rib edge, a waist edge, a linear edge, a pouch edge, and an angular edge;

the front panel being positioned in between the back panel and the front portion;

the back panel being perimetrically connected to the front panel;

the fastener connection flap being positioned in between the opening and the back panel;

the first releasable fastener being positioned in between the fastener connection flap and the front panel;

the at least one accessory pouch, the second releasable fastener, and the holster pocket being positioned in between the back panel and the front panel;

the headphone wire hole being traversed through the back panel; and the loop and the securing strip being adjacently positioned behind the back panel.

4. The upper body apparel with concealed pouches as claimed in claim 3 comprise:

the shoulder edge, the arm edge, the rib edge, the waist edge, the linear edge, and the angular edge being perimetrically positioned around the concealed section;

the linear edge being positioned parallel with the opening;

the rib edge being oppositely positioned from the linear edge;

the pouch edge and the waist edge being perpendicularly positioned in between the rib edge and the linear edge;

the pouch edge being adjacently extended from the linear edge;

the waist edge being extended from the linear edge to the rib edge;

the arm edge being adjacently positioned with the rib edge;

the angular edge being adjacently positioned with the linear edge;

the shoulder edge being positioned in between the angular edge and the arm edge;

the shoulder edge being positioned opposite from the waist edge;

the shoulder edge, the arm edge, the rib edge, the waist edge, and the linear edge being connected to the front portion, wherein the angular edge is not connected to either the front portion or the back portion; and the pouch edge being connected to the front pouch.

5. The upper body apparel with concealed pouches as claimed in claim 3 comprise:

the fastener connection flap being perimetrically connected to the waist edge, the linear edge, and the pouch edge.

6. The upper body apparel with concealed pouches as claimed in claim 3 comprise:

the first releasable fastener being centrally and adjacently positioned with the opening;

the first releasable fastener being connected to the fastener connection flap and to the front panel;

the second releasable fastener being positioned parallel with the first releasable fastener; and the second releasable fastener being connected to the back panel and the front panel.

7. The upper body apparel with concealed pouches as claimed in claim 3 comprise:

the at least one accessory pouch comprises a first pouch, a second pouch, and a third pouch;

the first pouch being adjacently positioned with the first releasable fastener;

the third pouch being adjacently positioned with the second releasable fastener;

the second pouch being positioned in between the first pouch and the third pouch;

the first pouch, the second pouch, and the third pouch being linearly positioned on the back panel along the waist edge;

the holster pocket being adjacently positioned with the second releasable fastener opposite from the at least one accessory pouch; and the holster pocket being positioned in between the second releasable fastener and the rib edge.

8. The upper body apparel with concealed pouches as claimed in claim 3 comprise:

the loop being oppositely positioned from the holster pocket;

the loop being connected to the back panel and the rib edge; and the securing strip being movably inserted through the loop.

9. An upper body apparel with concealed pouches comprise:

an upper body garment;

an opening;

a concealed section;

the upper body garment comprises a front portion, a back portion, a waist band, and a front pouch;

the concealed section comprises a front panel, a back panel, a fastener connection flap, a first releasable fastener, at least one accessory pouch, a second releasable fastener, a holster pocket, a headphone wire hole, a loop, a securing strip, and a plurality of connecting edges;

the plurality of connecting edges comprises a shoulder edge, an arm edge, a rib edge, a waist edge, a linear edge, a pouch edge, and an angular edge;

the front portion and the back portion being positioned atop the waist band;

the front portion and the back portion being adjacently positioned with each other;

the waist band being perimetrically connected to the front portion and the back portion;

the front pouch being centrally positioned on the front portion and adjacently positioned with the waist band;

the opening being perpendicularly positioned with the waist band;

the opening being positioned on the front panel and within the front pouch;

the concealed section being adjacently connected to the front portion and the front pouch through the plurality of connecting edges;

the front panel being positioned in between the back panel and the front portion;

the back panel being perimetrically connected to the front panel;

the fastener connection flap being positioned in between the opening and the back panel;

the first releasable fastener being positioned in between the fastener connection flap and the front panel;

the at least one accessory pouch, the second releasable fastener, and the holster pocket being positioned in between the back panel and the front panel;

the headphone wire hole being traversed through the back panel; and the loop and the securing strip being adjacently positioned behind the back panel.

10. The upper body apparel with concealed pouches as claimed in claim 9 comprise:

the shoulder edge, the arm edge, the rib edge, the waist edge, the linear edge, and the angular edge being perimetrically positioned around the concealed section;

the linear edge being positioned parallel with the opening;

the rib edge being oppositely positioned from the linear edge;

the pouch edge and the waist edge being perpendicularly positioned in between the rib edge and the linear edge;

the pouch edge being adjacently extended from the linear edge;

the waist edge being extended from the linear edge to the rib edge;

the arm edge being adjacently positioned with the rib edge;

the angular edge being adjacently positioned with the linear edge;

the shoulder edge being positioned in between the angular edge and the arm edge;

the shoulder edge being positioned opposite from the waist edge;

the shoulder edge, the arm edge, the rib edge, the waist edge, and the linear edge being connected to the front portion, wherein the angular edge is not connected to either the front portion or the back portion; and the pouch edge being connected to the front pouch.

11. The upper body apparel with concealed pouches as claimed in claim 9 comprise:

the fastener connection flap being perimetrically connected to the waist edge, the linear edge, and the pouch edge.

12. The upper body apparel with concealed pouches as claimed in claim 9 comprise:

the first releasable fastener being centrally and adjacently positioned with the opening;

the first releasable fastener being connected to the fastener connection flap and to the front panel;

the second releasable fastener being positioned parallel with the first releasable fastener; and the second releasable fastener being connected to the back panel and the front panel.

13. The upper body apparel with concealed pouches as claimed in claim 9 comprise:

the at least one accessory pouch comprises a first pouch, a second pouch, and a third pouch;

the first pouch being adjacently positioned with the first releasable fastener;

the third pouch being adjacently positioned with the second releasable fastener;

the second pouch being positioned in between the first pouch and the third pouch;

the first pouch, the second pouch, and the third pouch being linearly positioned on the back panel along the waist edge;

the holster pocket being adjacently positioned with the second releasable fastener opposite from the at least one accessory pouch; and the holster pocket being positioned in between the second releasable fastener and the rib edge.

14. The upper body apparel with concealed pouches as claimed in claim 9 comprise:

the loop being oppositely positioned from the holster pocket;

the loop being connected to the back panel and the rib edge; and the securing strip being movably inserted through the loop.

15. An upper body apparel with concealed pouches comprise:

an upper body garment;

an opening;

a concealed section;

the upper body garment comprises a front portion, a back portion, a waist band, and a front pouch;

the concealed section comprises a front panel, a back panel, a fastener connection flap, a first releasable fastener, at least one accessory pouch, a second releasable fastener, a holster pocket, a headphone wire hole, a loop, a securing strip, and a plurality of connecting edges;

the at least one accessory pouch comprises a first pouch, a second pouch, and a third pouch;

the plurality of connecting edges comprises a shoulder edge, an arm edge, a rib edge, a waist edge, a linear edge, a pouch edge, and an angular edge;

the front portion and the back portion being positioned atop the waist band;

the front portion and the back portion being adjacently positioned with each other;

the waist band being perimetrically connected to the front portion and the back portion;

the front pouch being centrally positioned on the front portion and adjacently positioned with the waist band;

the opening being perpendicularly positioned with the waist band;

the opening being positioned on the front panel and within the front pouch;

the concealed section being adjacently connected to the front portion and the front pouch through the plurality of connecting edges;

the front panel being positioned in between the back panel and the front portion;

the back panel being perimetrically connected to the front panel;

the fastener connection flap being positioned in between the opening and the back panel;

the first releasable fastener being positioned in between the fastener connection flap and the front panel;

the at least one accessory pouch, the second releasable fastener, and the holster pocket being positioned in between the back panel and the front panel;

the headphone wire hole being traversed through the back panel; and the loop and the securing strip being adjacently positioned behind the back panel.

16. The upper body apparel with concealed pouches as claimed in claim 15 comprise:

the shoulder edge, the arm edge, the rib edge, the waist edge, the linear edge, and the angular edge being perimetrically positioned around the concealed section;

the linear edge being positioned parallel with the opening;

the rib edge being oppositely positioned from the linear edge;

the pouch edge and the waist edge being perpendicularly positioned in between the rib edge and the linear edge;

the pouch edge being adjacently extended from the linear edge;

the waist edge being extended from the linear edge to the rib edge;

the arm edge being adjacently positioned with the rib edge;

the angular edge being adjacently positioned with the linear edge;

the shoulder edge being positioned in between the angular edge and the arm edge;

the shoulder edge being positioned opposite from the waist edge;

the shoulder edge, the arm edge, the rib edge, the waist edge, and the linear edge being connected to the front portion, wherein the angular edge is not connected to either the front portion or the back portion; and the pouch edge being connected to the front pouch.

17. The upper body apparel with concealed pouches as claimed in claim 15 comprise:

the fastener connection flap being perimetrically connected to the waist edge, the linear edge, and the pouch edge.

18. The upper body apparel with concealed pouches as claimed in claim 15 comprise:

the first releasable fastener being centrally and adjacently positioned with the opening;

the first releasable fastener being connected to the fastener connection flap and to the front panel;

the second releasable fastener being positioned parallel with the first releasable fastener; and the second releasable fastener being connected to the back panel and the front panel.

19. The upper body apparel with concealed pouches as claimed in claim 15 comprise:

the first pouch being adjacently positioned with the first releasable fastener;

the third pouch being adjacently positioned with the second releasable fastener;

the second pouch being positioned in between the first pouch and the third pouch;

the first pouch, the second pouch, and the third pouch being linearly positioned on the back panel along the waist edge;

the holster pocket being adjacently positioned with the second releasable fastener opposite from the at least one accessory pouch; and the holster pocket being positioned in between the second releasable fastener and the rib edge.

20. The upper body apparel with concealed pouches as claimed in claim 15 comprise:

the loop being oppositely positioned from the holster pocket;

the loop being connected to the back panel and the rib edge; and the securing strip being movably inserted through the loop.

* * * * *